US011162702B2

(12) United States Patent
Blair et al.

(10) Patent No.: US 11,162,702 B2
(45) Date of Patent: Nov. 2, 2021

(54) METHOD OF ASSOCIATING A DIAGNOSTIC MODULE TO HVAC SYSTEM COMPONENTS

(71) Applicant: Trane International Inc., Davidson, NC (US)

(72) Inventors: Daniel John Blair, Tyler, TX (US); Drew Whitehurst, Tyler, TX (US); Carl L. Garrett, Tyler, TX (US); Christopher Blake Smith, Whitehouse, TX (US); Bradley T. Wilson, Tyler, TX (US); James W. Barnard, Westminster, CO (US)

(73) Assignee: Trane International Inc., Davidson, NC (US)

( * ) Notice: Subject to any disclaimer, the term of this patent is extended or adjusted under 35 U.S.C. 154(b) by 1095 days.

(21) Appl. No.: 15/497,412

(22) Filed: Apr. 26, 2017

(65) Prior Publication Data

US 2017/0314797 A1 Nov. 2, 2017

Related U.S. Application Data

(60) Provisional application No. 62/328,791, filed on Apr. 28, 2016.

(51) Int. Cl.
*F24F 11/62* (2018.01)
*F24F 11/30* (2018.01)
(Continued)

(52) U.S. Cl.
CPC ..... *F24F 11/62* (2018.01); *F24F 11/30* (2018.01); *F24F 11/38* (2018.01); *F24F 11/52* (2018.01);
(Continued)

(58) Field of Classification Search
CPC .. F24F 11/62; F24F 11/38; F24F 11/30; F24F 11/52; F24F 11/63; F24F 11/58; F24F 2110/10
See application file for complete search history.

(56) References Cited

U.S. PATENT DOCUMENTS 5,185,860 A 2/1993 Wu
5,276,630 A 1/1994 Baldwin et al.
(Continued)

OTHER PUBLICATIONS

US 8,638,213 B2, 01/2014, Rezvani et al. (withdrawn)

*Primary Examiner* — Christopher E. Everett
(74) *Attorney, Agent, or Firm* — Womble Bond Dickinson (US) LLP

(57) ABSTRACT

Systems and methods are disclosed for validating the installation and operation of a fault detection and diagnostic module that monitors a component of an HVAC system. A remote diagnostic server is in operative communication with the HVAC system, and with the fault detection and diagnostic module. A user device communicates data to the remote diagnostic server that defines an association between the fault detection and diagnostic module and the HVAC system. The remote diagnostic server initiates an installation validation by sending a command to the HVAC system that causes the monitored component to initiate an event that is expected to be reported by the fault detection and diagnostic module. For example, a fan motor is turned on. If correctly installed, the fault detection and diagnostic module senses the event, and reports the event to the remote diagnostic server, which confirms the association. The remote diagnostic server sends a message to the user device indicating the result of the validation.

17 Claims, 4 Drawing Sheets

(51) Int. Cl.

| | |
|---|---|
| ***F24F 11/52*** | (2018.01) |
| ***F24F 11/38*** | (2018.01) |
| *F24F 11/63* | (2018.01) |
| *F24F 11/58* | (2018.01) |
| *F24F 110/10* | (2018.01) |

(52) U.S. Cl.
CPC ..... *F24F 11/58* (2018.01); *F24F 11/63* (2018.01); *F24F 2110/10* (2018.01)

(56) References Cited

U.S. PATENT DOCUMENTS

| | | | | |
|---|---|---|---|---|
| 5,444,851 | A | 8/1995 | Woest | |
| 5,511,188 | A | 4/1996 | Pascucci et al. | |
| 6,098,116 | A | 8/2000 | Nixon et al. | |
| 6,104,963 | A | 8/2000 | Cebasek et al. | |
| 6,112,127 | A | 8/2000 | Bennett | |
| 6,157,943 | A | 12/2000 | Meyer | |
| 6,353,853 | B1 | 3/2002 | Gravlin | |
| 6,389,331 | B1 | 5/2002 | Jensen et al. | |
| 6,487,457 | B1 | 11/2002 | Hull et al. | |
| 6,584,096 | B1 | 6/2003 | Allan | |
| 6,598,056 | B1 | 7/2003 | Hull et al. | |
| 6,636,893 | B1 | 10/2003 | Fong | |
| 6,834,298 | B1 | 12/2004 | Singer et al. | |
| 6,851,621 | B1 | 2/2005 | Wacker et al. | |
| 6,964,174 | B2 | 11/2005 | Shah | |
| 6,990,335 | B1 | 1/2006 | Shamoon et al. | |
| 7,000,422 | B2 | 2/2006 | Street et al. | |
| 7,017,827 | B2 | 3/2006 | Shah et al. | |
| 7,103,511 | B2 | 9/2006 | Petite | |
| 7,212,887 | B2 | 5/2007 | Shah et al. | |
| 7,240,106 | B2 | 7/2007 | Cochran et al. | |
| 7,249,170 | B2 | 7/2007 | Tindal et al. | |
| 7,634,555 | B1 | 12/2009 | Wainscott, Jr. et al. | |
| 7,664,573 | B2 | 2/2010 | Ahmed | |
| 7,765,826 | B2 | 8/2010 | Nichols | |
| 7,870,090 | B2 | 1/2011 | McCoy et al. | |
| 7,882,356 | B2 | 2/2011 | Klemets et al. | |
| 7,900,849 | B2 | 3/2011 | Barton et al. | |
| 7,904,209 | B2 | 3/2011 | Podgomy et al. | |
| 8,005,944 | B2 | 8/2011 | Fowler et al. | |
| 8,050,801 | B2 | 11/2011 | Richards et al. | |
| 8,078,325 | B2 | 12/2011 | Poth | |
| 8,099,195 | B2 | 1/2012 | Imes et al. | |
| 8,147,302 | B2 | 4/2012 | Desrochers et al. | |
| 8,219,660 | B2 | 7/2012 | McCoy et al. | |
| 8,290,627 | B2 | 10/2012 | Richards et al. | |
| 8,295,981 | B2 | 10/2012 | Hadzidedic | |
| 8,493,838 | B2 | 7/2013 | Sato et al. | |
| 8,550,370 | B2 | 10/2013 | Barrett et al. | |
| 8,600,556 | B2 | 12/2013 | Nesler et al. | |
| 8,723,664 | B2 | 5/2014 | Rezvani et al. | |
| 8,761,945 | B2 | 6/2014 | Hadzidedic | |
| 8,788,100 | B2 | 7/2014 | Grohman et al. | |
| 8,793,022 | B2 | 7/2014 | Uden | |
| 8,981,950 | B1 | 3/2015 | Kates | |
| 9,021,462 | B2 | 4/2015 | Gupta | |
| 9,247,322 | B1 * | 1/2016 | Schechter | H04Q 9/00 |
| 9,605,859 | B2 | 3/2017 | Uden | |
| 2002/0031101 | A1 | 3/2002 | Petite et al. | |
| 2003/0084176 | A1 | 5/2003 | Tewari et al. | |
| 2004/0143510 | A1 | 7/2004 | Haeberle et al. | |
| 2004/0148288 | A1 | 7/2004 | Haeberle et al. | |
| 2005/0177269 | A1 * | 8/2005 | Funk | G05B 19/4187 700/121 |
| 2006/0010232 | A1 | 1/2006 | Page et al. | |
| 2006/0155824 | A1 | 7/2006 | Motoyama et al. | |
| 2006/0184659 | A1 | 8/2006 | Motoyama et al. | |
| 2007/0005736 | A1 | 1/2007 | Hansen et al. | |
| 2007/0055760 | A1 | 3/2007 | Mccoy et al. | |
| 2007/0139183 | A1 * | 6/2007 | Kates | G08B 25/14 340/521 |
| 2009/0239587 | A1 | 9/2009 | Negron et al. | |
| 2010/0106319 | A1 * | 4/2010 | Grohman | G05D 27/02 700/276 |
| 2010/0257455 | A1 | 10/2010 | Park et al. | |
| 2011/0047418 | A1 * | 2/2011 | Drees | G05B 23/00 714/57 |
| 2013/0024799 | A1 | 1/2013 | Fadell et al. | |
| 2013/0173064 | A1 | 7/2013 | Fadell et al. | |
| 2013/0201316 | A1 | 8/2013 | Binder et al. | |
| 2013/0261807 | A1 * | 10/2013 | Zywicki | F24F 11/30 700/278 |
| 2014/0159879 | A1 | 6/2014 | Rezvani et al. | |
| 2014/0244833 | A1 * | 8/2014 | Sharma | H04L 12/281 709/224 |
| 2014/0266755 | A1 * | 9/2014 | Arensmeier | F24F 11/62 340/679 |
| 2014/0375436 | A1 | 12/2014 | Rezvani et al. | |
| 2014/0375437 | A1 | 12/2014 | Rezvani et al. | |
| 2014/0375438 | A1 | 12/2014 | Rezvani et al. | |
| 2015/0011209 | A1 | 1/2015 | Rezvani et al. | |
| 2015/0106487 | A1 | 4/2015 | Rezvani et al. | |
| 2015/0161875 | A1 * | 6/2015 | Cohn | G08B 25/10 340/501 |
| 2015/0350031 | A1 | 12/2015 | Burks et al. | |
| 2015/0369671 | A1 * | 12/2015 | Schechter | G08B 21/182 340/584 |
| 2018/0254916 | A1 * | 9/2018 | Kaag | H04L 12/2814 |

* cited by examiner

METHOD OF ASSOCIATING A DIAGNOSTIC MODULE TO HVAC SYSTEM COMPONENTS

CROSS-REFERENCE TO RELATED APPLICATION

This application claims the benefit of and priority to U.S. Provisional Application Ser. No. 62/328,791 entitled "METHOD OF ASSOCIATING A DIAGNOSTIC MODULE TO HVAC SYSTEM COMPONENTS" and filed Apr. 28, 2016, the entirety of which is hereby incorporated by reference herein for all purposes.

BACKGROUND

1. Technical Field

The present disclosure is directed to fault detection and diagnostics in a heating, air conditioning, and ventilation (HVAC) system, and in particular, to systems and methods for verifying proper installation and operation of a fault detection and diagnostic module with respect to an associated HVAC component.

2. Background of Related Art

HVAC systems include a number of components that are subject to wear and tear or other faults, which, if undetected, can degrade system efficiency, cause component failure or system shutdown, and, ultimately, cause customer dissatisfaction. As a result, manufacturers have placed increased emphasis on the detection and diagnosis of HVAC component faults in order to enhance the reliability of HVAC systems, and to reduce the impact of faults when they do occur.

A typical HVAC system includes components such as a compressor, an outdoor unit fan, and an indoor unit fan, each of which is driven by its own electric motor. Some HVAC systems include other components, such as auxiliary heaters, reversing valves (e.g., as employed in a heat pump), dampers, and so forth. If a failure occurs in an HVAC component, a service technician is called to the site to troubleshoot the problem using diagnostic tools such as multimeters, pressure and temperature gauges, and so forth. Some HVAC systems include a self-diagnosis feature which displays diagnostic information, such as a trouble code, on a display panel accessible to a technician at the site. Such self-diagnostic features may have limited benefit, because the information provided by such a feature is only available at the unit (which may be in a hard-to-reach location, such as an attic or crawl space), and may not include information about other components in the system.

Dedicated monitoring devices have been devised which collect diagnostic data from HVAC components during operation, however many service technicians have been reluctant to embrace this technology because installing and configuring these devices can be tedious, error-prone, and time-consuming. An HVAC monitoring device which is easily installable and configurable would be a welcome advance in the art.

SUMMARY

In one aspect, the present disclosure is directed to a method for a diagnostic server to digitally associate a diagnostic module with a system controller, such as a thermostat, in an HVAC system. In an exemplary embodiment, the method includes the server sending a command message to the thermostat directing operation of a component in the HVAC system. The diagnostic module detects a process response in the HVAC system and sends a message to the server reporting the process response. The message may include HVAC system identifying information. The server associates the thermostat with the diagnostic module based on the process response message.

In some embodiments, the method includes establishing a connection between the server and the diagnostic module through a router. In some embodiments, the identifying information includes an Internet address for the router. In some embodiments, the command message is sent to the thermostat through the router. In some embodiments, the method includes a user initiating the associating process on the thermostat. In some embodiments, the diagnostic module automatically requests initiation of the associating process after the connection is established. In some embodiments, a user establishes the connection by interacting with the diagnostic module through a user interface and further comprising the user initiating the associating process by establishing the connection.

In another aspect, the present embodiment is directed to a diagnostic server for an HVAC system. The HVAC system includes a thermostat having an Internet connection through a router, indoor HVAC equipment in communication with the thermostat and outdoor HVAC equipment in communication with the thermostat. The indoor and/or outdoor HVAC equipment may be coupled to the thermostat via a wired (e.g., electrical or optical) or wireless (e.g., WiFi, Z-Wave, Zigbee, Bluetooth) connection. The HVAC system includes one or more diagnostic modules that receive sensor data from the indoor HVAC equipment and the outdoor HVAC equipment, and send messages through the Internet to a diagnostic server. At least one of the diagnostic modules has a wireless Internet connection through a router to the diagnostic server. The diagnostic server includes an Internet interface configured to send a command message to the thermostat directing operation of one or more components in the indoor HVAC equipment and the outdoor HVAC equipment, and receive a message comprising HVAC system identifying information and HVAC system process information from the diagnostic module. The diagnostic server also includes a database configured to record the association of the thermostat with the diagnostic module.

In some embodiments, the HVAC system identifying information includes an Internet address for the router. In some embodiments, the diagnostic server is configured to receive an initiating message from the thermostat. In some embodiments, the diagnostic server is configured to receive an initiating message from the diagnostic module. In some embodiments, the diagnostic server is configured to send a message though the diagnostic module to a user interface indicating the association of the thermostat with the diagnostic module.

In yet another aspect, the present disclosure is directed to a fault detection and diagnostic module for use with an HVAC component. In an exemplary embodiment, the fault detection and diagnostic module includes an electrical interface configured for receiving a sensed property of the HVAC component, a wireless network interface configured for operation in an ad-hoc mode and an infrastructure mode, a processor, and non-transitory memory. The non-transitory memory includes a set of executable instructions which, when executed by the processor, cause the fault detection and diagnostic module to operate the wireless network interface in an ad-hoc mode to communicate with a user device, receive network credentials from the user device, utilize the network credentials operate the wireless network interface in an infrastructure mode to communicate with a wireless router, and transmit an association request via the wireless network interface in an infrastructure mode to a remote diagnostic server.

In some embodiments, the set of executable instructions cause the fault detection and diagnostic module to receive an association results message from the remote diagnostic server indicative of the results of an association process. In some embodiments, the executable instructions cause the fault detection and diagnostic module to transmit a message based at least in part upon the association results message to the user device. In some embodiments, the set of executable instructions cause the fault detection and diagnostic module to receive an association initialization request from the user device. In some embodiments, the set of executable instructions cause the fault detection and diagnostic module to transmit a diagnostic message to the remote diagnostic server in accordance with a sensed property of the HVAC component received by the electrical interface.

In some embodiments, the fault detection and diagnostic module includes a diagnostic data bus communications interface configured for receiving diagnostic data from a second fault detection and diagnostic module. In some embodiments, the set of executable instructions cause the fault detection and diagnostic module to transmit diagnostic data received from a second fault detection and diagnostic module to the remote diagnostic server.

In still another aspect, the present disclosure is directed to an HVAC diagnostic system. In an exemplary embodiment, the HVAC diagnostic system includes an HVAC system which includes a thermostat having an Internet connection through a router, indoor HVAC equipment comprising a plurality of components electrically connected to the thermostat, outdoor HVAC equipment comprising a plurality of components electrically connected to the thermostat, and one or more diagnostic modules having a wireless Internet connection through a router, wherein the diagnostic modules receive sensor data from the indoor HVAC equipment and the outdoor HVAC equipment and send messages through the Internet. The HVAC diagnostic system also includes a diagnostic server having an Internet interface configured to send a command message to the thermostat directing operation of the plurality of components in the indoor HVAC equipment and the outdoor HVAC equipment and receive a message comprising HVAC system identifying information and HVAC system process information from the one or more diagnostic modules, and a database configured to record an association of the thermostat with the diagnostic module.

BRIEF DESCRIPTION OF THE DRAWINGS

Various embodiments of the disclosed system and method are described herein with reference to the drawings wherein.

Figure 1:
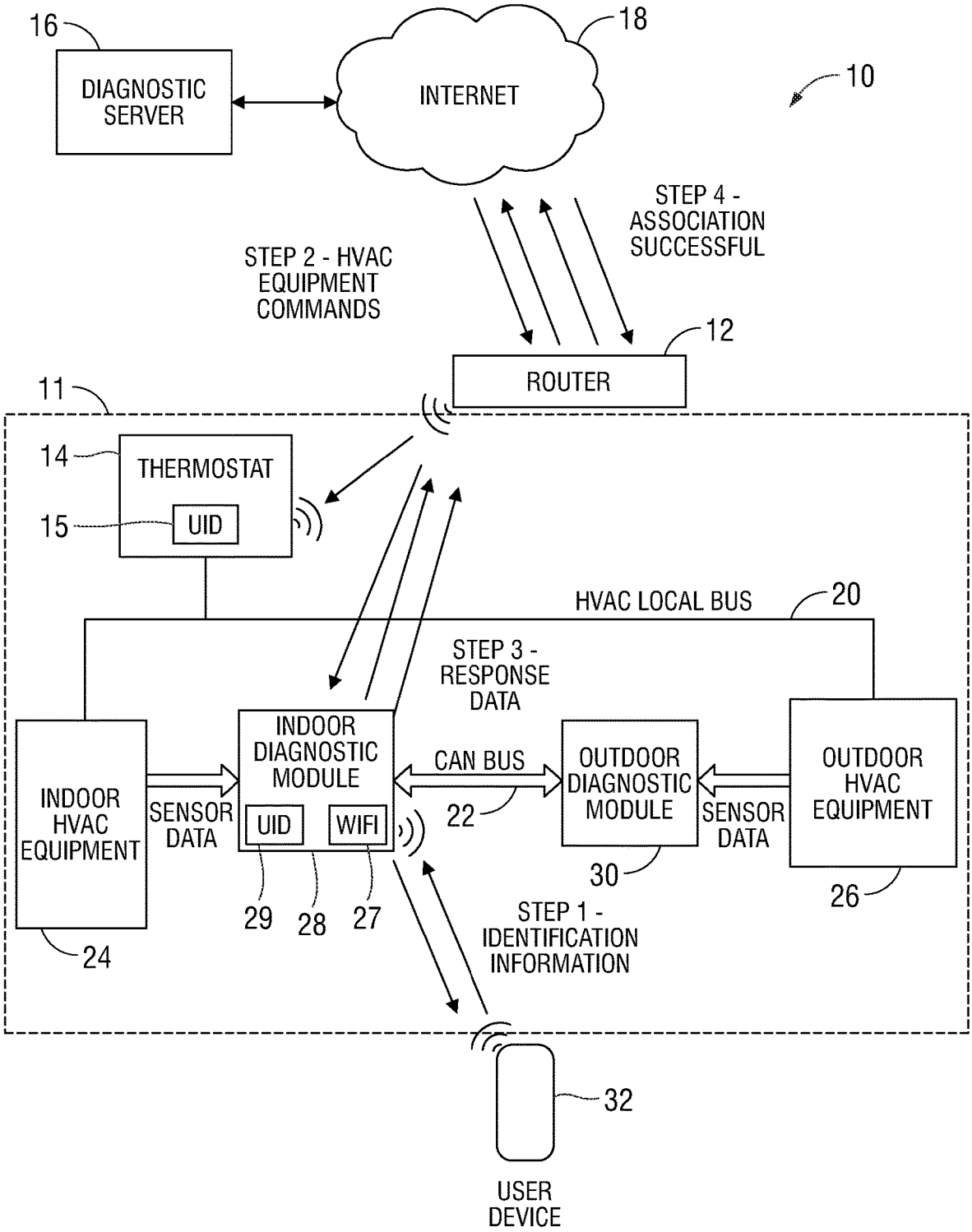
FIG. 1 is a block diagram of an HVAC diagnostic system configured for automatic association of a diagnostic module with a diagnostic server in accordance with an embodiment of the present disclosure.
Figure 2:
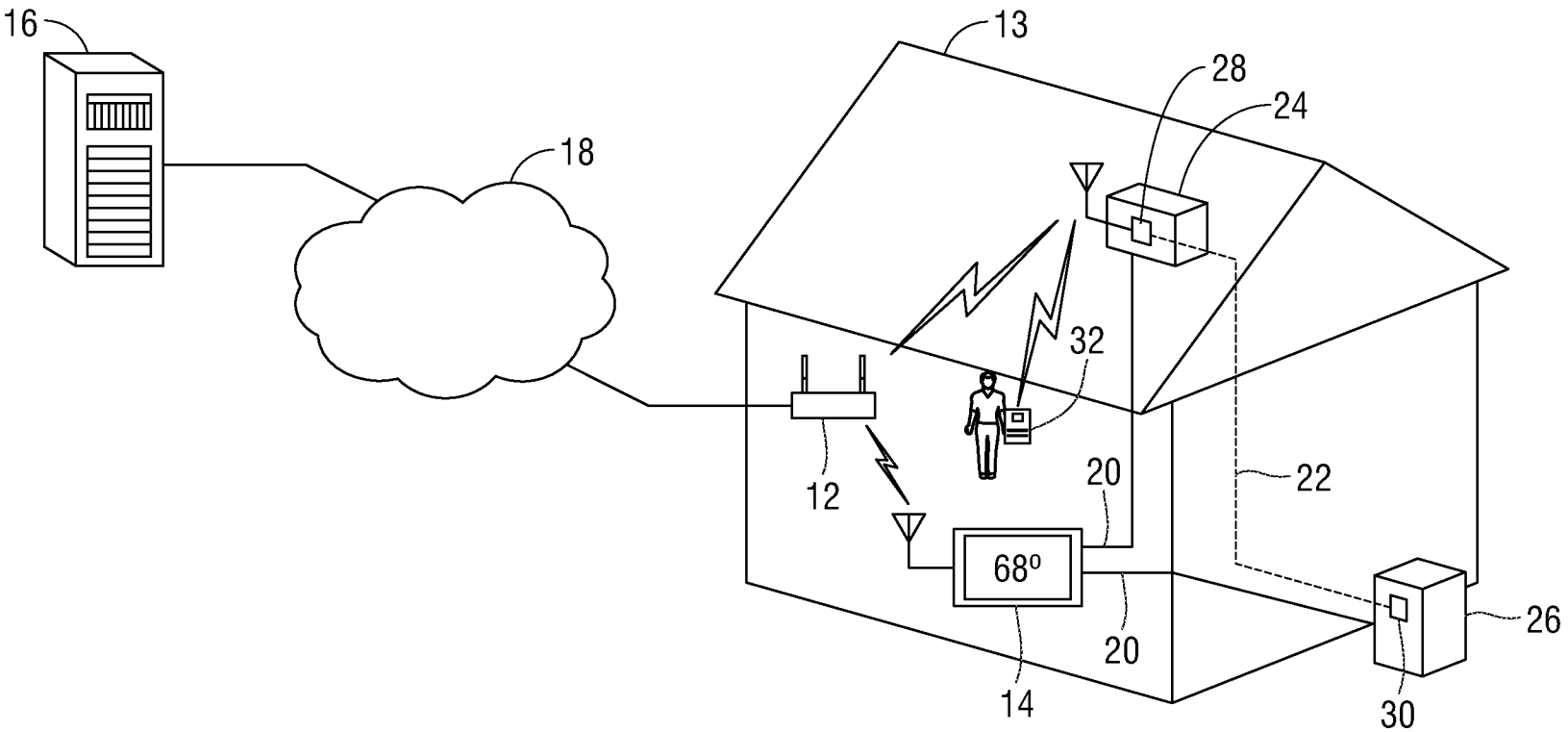
FIG. 2 is a pictorial diagram of the HVAC diagnostic system of FIG. 1 installed at a customer site.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements which may perform the same, similar, or equivalent functions. The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary."

The present disclosure is described herein in terms of functional block components and various processing and communication steps. It should be appreciated that such functional blocks configured to perform the specified functions may be embodied in analog circuitry, digital circuitry, and/or instructions executable on a processor. For example, the present disclosure may employ various discrete components, integrated circuit components (e.g., memory elements, processing elements, communications elements, logic elements, look-up tables, and the like) which may carry out a variety of functions, whether independently, in cooperation with one or more other components, and/or under the control of one or more processors or other control devices. It should be appreciated that the particular implementations described herein are illustrative of the disclosure and its best mode and are not intended to otherwise limit the scope of the present disclosure in any way.

The present disclosure is directed to improved systems and methods for associating an internet-enabled HVAC diagnostic module with the specific HVAC equipment to which the diagnostic module is connected. The disclosed method provides a closed-loop confirmation that eliminates the need for manual or human intervention, thus saving time and eliminating data entry errors. A command or set of commands is initiated by a remote diagnostic server and sent to a thermostat, which, in turn, controls the monitored equipment. The equipment's response to this command is then sensed by the diagnostic module, and transmitted back to the diagnostic server. Upon receiving this data, the diagnostic server is able to confirm that proper association between the diagnostic module and equipment has been established. The diagnostic server stores the identity of the thermostat and of the diagnostic modules as being associated at a single customer site, such as a residence or commercial building. This information may also stored in association with a customer account for providing service, for collecting performance and fault data for analysis, and so forth.

An HVAC installation includes a diagnostic module configured to monitor the indoor HVAC unit and the outdoor HVAC unit. The diagnostic module includes a wireless interface (e.g., a WiFi interface) to provide connectivity to the remote diagnostic server. In some embodiments, an indoor diagnostic module is configured to monitor the indoor HVAC unit, and an outdoor diagnostic module is configured to monitor the outdoor HVAC unit. Indoor and outdoor diagnostic modules communicate with each other via a dedicated diagnostic bus. The outdoor diagnostic module communicates its diagnostic information to the indoor module. The indoor module communicates its diagnostic information, as well as diagnostic information received from the outdoor module, to the remote diagnostic server. A diagnostic server, diagnostic modules, and a dedicated diagnostic data bus for use with an HVAC system are disclosed in co-owned U.S. Utility patent application Ser. No. 15/006,651, filed Jan. 26, 2016, entitled "Remote Monitoring of an HVAC System for Fault Detection and Diagnostics" and in co-owned U.S. Utility patent application Ser. No. 15/006,584, filed Jan. 26, 2016, entitled "Diagnostic Data Bus for Acquiring and Communicating Diagnostic Information from HVAC Systems," the entirety of each which is incorporated herein by reference.

Initially, the indoor diagnostic module is configured to become a member of a wireless WiFi network at the site. To accomplish this, upon initial power-up, or alternatively, in response to a user input such as a button-press, the diagnostic module provides an ad-hoc WiFi network to which a user device (smart phone, tablet, notebook computer, etc.) is joined. The indoor diagnostic module includes a webserver which provides a web-based interface to the user device upon establishment of the ad-hoc connection, which facilitates entry of local WiFi authentication credentials (SSID, and if required, a wireless password) for the wireless router at a particular site into indoor diagnostic module the indoor diagnostic module. The indoor diagnostic module then uses the authentication credentials to connect to the local WiFi network to establish an Internet connection through the wireless router.

To associate the diagnostic module to the HVAC system, the diagnostic module passes a request, which contains the public IP of the local site (or an alternate unique identifier) to the diagnostic server. When the diagnostic server receives this request, it in turn issues a command to the thermostat associated with the same public IP (or same alternate unique identifier) as the diagnostic module. For example, a command "turn on the indoor blower" is sent to the thermostat, which in turn, causes the indoor blower to turn on. By design, the diagnostic module senses the fact that the indoor blower has been activated, and communicates data conveying this fact back to the diagnostic server. Once the diagnostic server receives the expected response from the diagnostic module, e.g., that the indoor blower is indeed on, the association between the diagnostic module(s) and the premises HVAC equipment is confirmed. A unique identifier of the diagnostic module is stored by the diagnostic server, together with a unique identifier of the thermostat, and other information relating to the installation (e.g., account identification, customer name, address, equipment model numbers, installation date, warranty information, customer service notes, historical fault and service data, and so forth).

With reference to FIG. 1, an exemplary embodiment of an HVAC diagnostic system 10 configured for automatic association of a diagnostic module 28, 30 with a diagnostic server 16 is shown. The system 10 includes a diagnostic server 16 that is specially configured to implement and execute the methods of the present disclosure and for operative communication with one or more components of an HVAC system 11. HVAC system includes a thermostat 14 in operative communication with an HVAC indoor unit 24 and an HVAC outdoor unit 26. Indoor unit 24 includes an electrically-powered blower to circulate indoor air through indoor unit 24, and may be configured as a furnace/evaporator coil combination unit, a package unit, a modular air handler, a dedicated air handler, and the like. Outdoor unit 26 includes an electrically-powered compressor and an electrically-powered fan, and may be configured as an air conditioner condensing unit or a heat pump.

Thermostat 14 controls the operation of indoor unit 24 and outdoor unit 26 via local control bus 20. Local control bus 20 operates using any communications protocol suitable for use in HVAC system 11. For example, and without limitation, where indoor unit 24 and/or outdoor unit 26 employ single- or dual-speed motors, local control bus 20 may operate using 24V switched circuits which typically correspond to well-known color coding schemes (Rc, Rh, C, Y, W, Y2, W2, G, E, O, V, etc.). In variable-speed installations, local control bus 20 may employ digital signaling protocols such as, without limitation, CAN bus, RS-485, ComfortLink II™, ClimateTalk™, and the like.

Thermostat 14 controls the operation of indoor unit 24 and/or outdoor unit 26 in accordance with user inputs (eg., temperature setpoints, scheduled setbacks, and the like) in combination with environmental inputs (such as those obtained from, e.g., temperature, humidity, and/or occupancy sensors) to achieve the desired environmental conditions within the premises 13 in which HVAC system 11 is installed. Thermostat 14 additionally is configured to control the operation of indoor unit 24 and/or outdoor unit 26 in accordance with remote commands received from diagnostic server 16, enabling indoor unit 24 and/or outdoor unit 26 to be remote-controlled by diagnostic server 16.

Thermostat 14 includes a unique identifier 15, such as an electronic serial number, an IP address, and/or combinations thereof, which identifies thermostat 14 to diagnostic server 16. Indoor diagnostic module 28 includes a unique identifier 29, such as an electronic serial number, an IP address, and/or combinations thereof, which identifies indoor diagnostic module 28 to diagnostic server 16. At least a portion of the unique identifier 15 and/or unique identifier 29 may be stored in read-only (unalterable) memory included within thermostat 14 and/or indoor diagnostic module 28, respectively. It is an aspect of the present disclosure to enable the diagnostic server 16 to associate the unique identifier 15 of thermostat 14 with the unique identifier 29 of indoor diagnostic module 28 in a substantially automated manner, e.g., with minimal or no human intervention.

In some embodiments, where the HVAC system does not include a traditional thermostat in favor of a separate HVAC system controller or an HVAC system controller included with another HVAC component (e.g., an air handler or furnace), the techniques described herein may be used to associate a diagnostic module with the HVAC system controller in use with any particular system.

Indoor diagnostic module 28 is configured to sense one or more operational parameters of indoor unit 24 and communicate data indicative of the sensed parameters to diagnostic server 16. Examples of operational parameters of indoor unit 24 which may be sensed by indoor diagnostic module 28 include, without limitation, blower motor current, blower motor speed, indoor liquid temperature, air inlet temperature, air outlet temperature, and so forth. Outdoor diagnostic module 30 is configured to sense one or more operational parameters of outdoor unit 26 and communicate data indicative of the sensed parameters to indoor diagnostic module 28. Examples of operational parameters of outdoor unit 26 which may be sensed by outdoor diagnostic module 30 include, without limitation, compressor motor current, compressor motor speed, saturated suction pressure and/or temperature, saturated discharge pressure and/or temperature, fan motor current, fan motor speed, reversing valve status, and so forth. Indoor diagnostic module 28 is further configured to receive diagnostic data from outdoor diagnostic module 30 and to communicate the outdoor data to diagnostic server 16.

Indoor diagnostic module 28 includes a WiFi interface 27. Upon initial power-up, or alternatively, in response to a user input such as a button-press, indoor diagnostic module 28 configures WiFi interface 27 to operate in an ad-hoc WiFi mode to enable a user device 32 to connect to indoor diagnostic module 28 to facilitate preliminary network setup, e.g., to establish a network connection between indoor diagnostic module 28 and router 12.

Figure 3C:
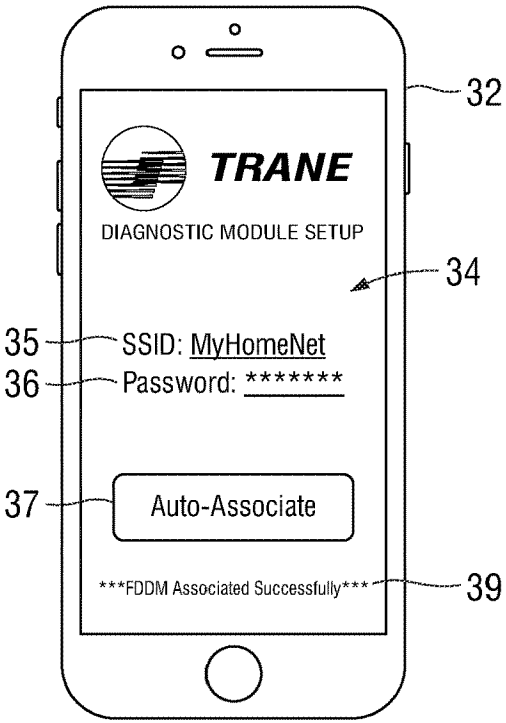
FIG. 3C illustrates yet another user interface for associating an HVAC diagnostics module in accordance with an embodiment of the present disclosure.
Figure 3B:
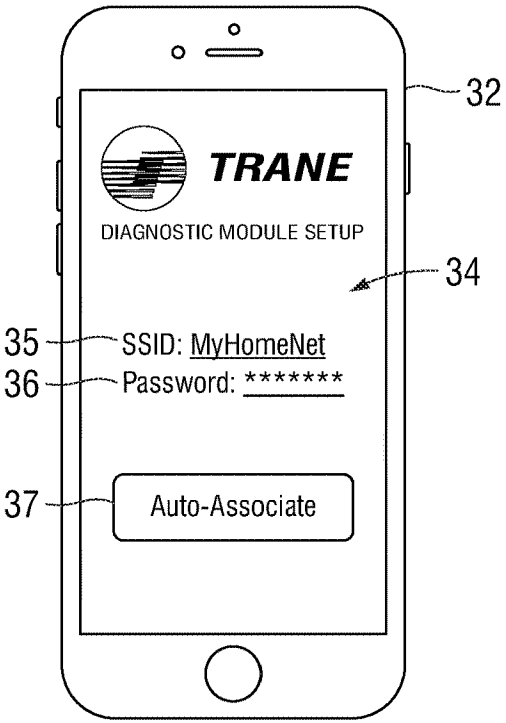
FIG. 3B illustrates another user interface for associating an HVAC diagnostics module in accordance with an embodiment of the present disclosure.
Figure 3A:
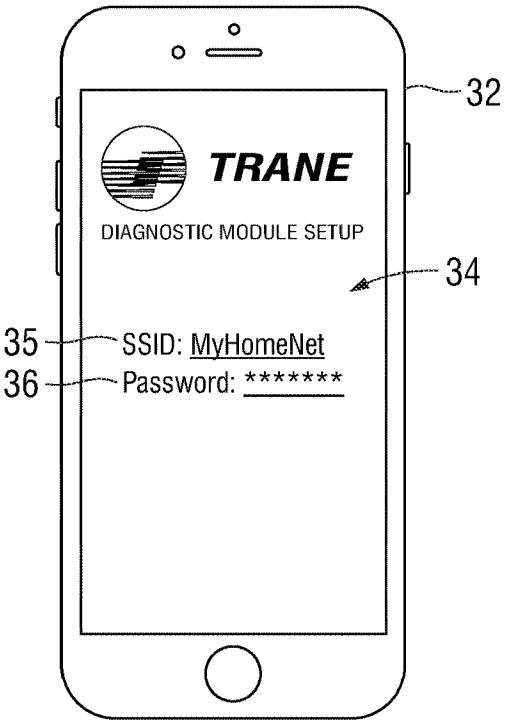
FIG. 3A illustrates a user interface for associating an HVAC diagnostics module in accordance with an embodiment of the present disclosure.

With reference now to FIGS. 3A-3C, indoor diagnostic module 28 includes a webserver which provides a web-based interface 34 to the user device 32 upon establishment of the ad-hoc connection. User interface 34 includes a network SSID data entry field 35 and a password data entry field 36 into which a user enters the WiFi authentication credentials required to join the local WiFi network of router 12. User interface 34 may include additional fields as required, for example, to enter an alternate unique identifier. Upon successful connection of indoor diagnostic module 28 to router 12, an auto-associate button 37 enables the user to initiate an association process (FIG. 3B). In some embodiments, indoor diagnostic module 28 optionally or alternatively initiates the association process immediately upon successful connection to router 12, e.g., without requiring the use of auto-associate button 37. In yet other embodiments, a user may initiate the association process by employing an auto-associate button, or similar user interface element, that is provided by thermostat 14. A status message 39 is displayed upon completion of the auto-association process (FIG. 3C). In some embodiments, a progress bar may be displayed to inform the user as steps of the process are completed. For example, "connecting to router," "router connected," "connecting to remote server," "performing auto-association," "association successful" and/or "association failure" may be presented on user interface 34 to keep the user informed as to the status of the HVAC diagnostic module association process.

Figure 4:
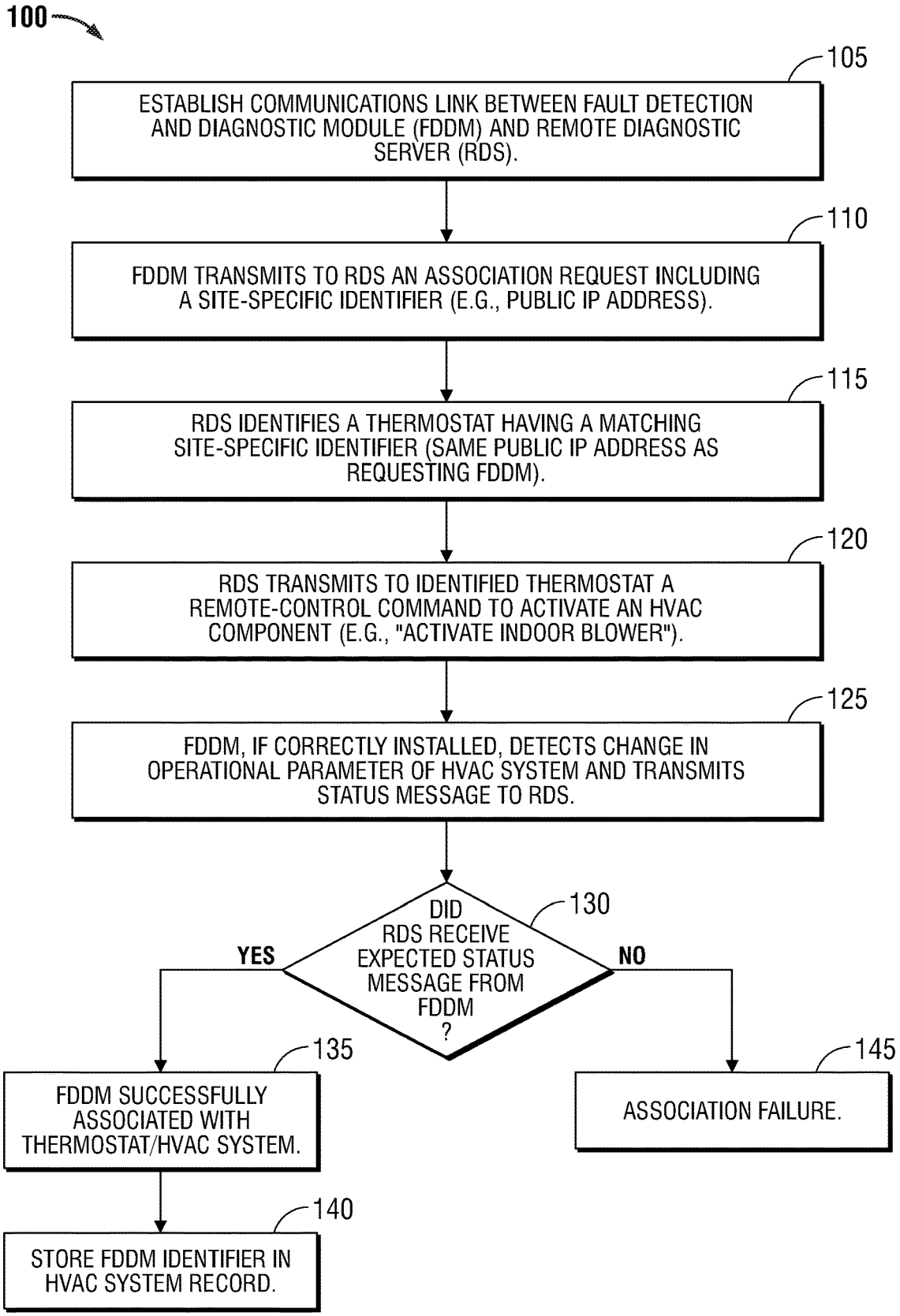
FIG. 4 is a flow chart illustrating a method of associating a diagnostic module with a thermostat in an HVAC system in accordance with an embodiment of the present disclosure.

With reference to FIG. 4, an HVAC diagnostic module association process 100 in accordance with the present disclosure is described in more detail. In step 105, a communications link is established between indoor diagnostic module 28 and remote diagnostic server 16. In embodiments, the communications link is established, at least in part, by indoor diagnostic module 28 receiving authentication credentials required to join a wireless (WiFi) network which includes as one of its nodes thermostat 14. In some embodiments, the communications link is established, at least in part, by indoor diagnostic module 28 obtaining a local network address (e.g., private IP address), which may be obtained via user input or may be obtained automatically from the network (e.g., via dynamic host configuration protocol, also referred to as DHCP). In some embodiments, internet connectivity between indoor diagnostic module 28 and remote diagnostic server 16 may be confirmed by sending a test message from indoor diagnostic module 28 to a remote network node (e.g., to remote diagnostic server 16) and receiving, at indoor diagnostic module 28, a response therefrom to confirm the establishment of the network communication link.

In step 110, indoor diagnostic module 28 causes an association request message to be transmitted the remote diagnostic server. The association request message includes a unique identifier of the diagnostic module and the public IP address of indoor diagnostic module 28. Note that, while indoor diagnostic module 28 and thermostat 14 each have distinct local (non-public) IP addresses, indoor diagnostic module 28 and thermostat 14 share a common public IP address identified with router 12, which serves as the internet gateway for the local WiFi network for indoor diagnostic module 28 and thermostat 14.

Upon receipt of the association request, diagnostic server 16 queries a database to identify a thermostat having the same public IP as indoor diagnostic module 28, which, here, is thermostat 14. If additional information is required to facilitate remote communication between diagnostic server 16 and thermostat 14 (e.g., login credentials needed to remotely access thermostat 14), this information is retrieved from the database. In step 120, the diagnostic server 16 transmits a remote command to thermostat 14 to change a current operational status of HVAC indoor unit 24 and/or HVAC outdoor unit 26. An example remote command may include "turn on HVAC indoor unit 24," "change compressor speed of HVAC outdoor unit 26" and so forth.

In some embodiments, diagnostic server 16 will, upon receipt of an association request from diagnostic module 28, transmit a remote command to thermostat 14 using the public IP address included within the association request, and, optionally, predetermined authentication credentials which are reserved for diagnostic use. In these embodiments, diagnostic server 16 is able to associate a diagnostic module 28 to HVAC system 11, which includes thermostat 14, HVAC indoor unit 24 and/or HVAC outdoor unit 26, without the need for a customer account, or any other data relating to HVAC system, to be established or stored prior to performing association process 100.

Thermostat 14 executes the remote command received from diagnostic server 16, which in turn, causes the specified HVAC component to perform the specified operation. If the diagnostic module connected to the specified HVAC component is properly installed and provisioned, it will sense the new operational state of the specified HVAC component, and, as expected, transmit a diagnostic message to remote server 16 that indicates the new operational state. If the expected message is received by diagnostic server 16, the association is deemed a success, and the fact of the association is recorded by diagnostic server 16.

For example, if diagnostic server 16 sent a remote command "set compressor speed of outdoor unit to maximum" to thermostat 14, HVAC outdoor unit 26 would respond in kind. Outdoor diagnostic module 30 then, if properly functioning, detects the compressor speed change exhibited by HVAC outdoor unit 26 and communicates a diagnostic message conveying the changed status to indoor diagnostic module 28 via dedicated diagnostic bus 22 (step 125). Next, indoor diagnostic module 28 transmits the diagnostic message to diagnostic server 16. Note that the detection may be accomplished by, for example, a speed sensor (tachometer) coupled to the compressor shaft, by detecting an input current or other electrical property (e.g., back EMF) of the compressor motor, or by detecting a pressure or temperature differential seen between the compressor suction and discharge ports.

In step 130, if diagnostic server 16 receives the expected diagnostic message from the target diagnostic module, it is concluded in step 135 that the target diagnostic module is properly associated with thermostat 14, HVAC system 11, and/or premises 13 and, optionally, in the step 140 the fact of this association is recorded by diagnostic server 16 to facilitate subsequent diagnostic data analysis. On the other hand, if the expected diagnostic message is not received, in step 145 it is concluded that the association has failed. In some embodiments, if the diagnostic message is received but contains unexpected results, the association may be deemed inconclusive. In embodiments, diagnostic server 16 transmits a message indicating the results of the association process to indoor diagnostic module 28. In embodiments, the results of the association process (success, failure, inconclusive) are conveyed by indoor diagnostic module 28 to user device 32 and/or thermostat 14. In embodiments, the results of the association process are conveyed by diagnostic server 16 to indoor diagnostic module 28, user device 32, and/or thermostat 14.

In another aspect, an alternative method of association is disclosed which requires little or no user input. Since all thermostat events and all diagnostic events are stored in diagnostic server 16, an attempt is made to automatically pair the devices by comparing the two sequences of events to identify a correlation between thermostat events (e.g., call for cooling) and diagnostic events (e.g., compressor on and indoor unit blower on) over a period of time. As the period of time that a correlation is identified increases, the confidence that the devices are connected to the same system also increases. After reaching a predetermined confidence threshold, the association of thermostat 14 and indoor diagnostic module 28 is deemed to be established. In embodiments, the results of the association process are conveyed by diagnostic server 16 to indoor diagnostic module 28, user device 32, and/or thermostat 14.

Note that, in order to efficiently match diagnostic devices and thermostats, only those devices and thermostats which are not known to be associated are considered for event sequence correlation. In some embodiments, an installer can initiate pairing by exercising some predetermined thermostat control gesture (e.g., fan mode: on-auto-on-auto a number of times). The predefined sequence of events emanating from each device (thermostat and diagnostic device) are detected by diagnostic server 16, which, in turn, initiate correlation detection between thermostat events and diagnostic events. Such an approach also has advantages in that the installer is not required to generate any inputs into the thermostat other than to simply perform the predetermined thermostat control gesture.

ASPECTS

It is noted that any of aspects 1-7, any of aspects 8-12, any of aspects 13-19, and/or aspect 20 may be combined with each other in any combination.

Aspect 1. A method of a diagnostic server digitally associating a diagnostic module with a thermostat in an HVAC system, the method comprising the server sending a command message to the thermostat directing operation of a component in the HVAC system; the diagnostic module detecting a process response in the HVAC system and sending a message to the server reporting the process response and comprising HVAC system identifying information; and the server associating the thermostat with the diagnostic module.

Aspect 2. The method according to aspect 1, further comprising establishing a connection between the server and the diagnostic module through a router.

Aspect 3. The method according to any of aspects 1-2, wherein the identifying information includes an Internet address for the router.

Aspect 4. The method according to any of aspects 1-3, wherein the command message is sent to the thermostat through the router.

Aspect 5. The method according to any of aspects 1-4, further comprising a user initiating the associating process on the thermostat.

Aspect 6. The method according to any of aspects 1-5, further comprising the diagnostic module automatically requesting initiation of the associating process after the connection is established.

Aspect 7. The method according to any of aspects 1-6, wherein a user establishes the connection by interacting with the diagnostic module through a user interface and further comprising the user initiating the associating process by establishing the connection.

Aspect 8. A diagnostic server for an HVAC system comprising a thermostat having an Internet connection through a router, indoor HVAC equipment electrically connected to the thermostat, outdoor HVAC equipment electrically connected to the thermostat, and one or more diagnostic modules having a wireless Internet connection through a router to the diagnostic server that receive sensor data from the indoor HVAC equipment and the outdoor HVAC equipment and send messages through the Internet to a diagnostic server, the server comprising an Internet interface configured to send a command message to the thermostat directing operation of one or more components in the indoor HVAC equipment and the outdoor HVAC equipment and receive a message comprising HVAC system identifying information and HVAC system process information from the diagnostic module; and a database configured to record the association of the thermostat with the diagnostic module.

Aspect 9. The diagnostic server according to aspect 8, wherein the identifying information includes an Internet address for the router.

Aspect 10. The diagnostic server according to any of aspects 8-9, further configured to receive an initiating message from the thermostat.

Aspect 11. The diagnostic server according to any of aspects 8-10, further configured to receive an initiating message from the diagnostic module.

Aspect 12. The diagnostic server according any of aspects 8-11, further configured to send a message though the diagnostic module to a user interface indicating the association of the thermostat with the diagnostic module.

Aspect 13. A fault detection and diagnostic module for use with an HVAC component, comprising an electrical interface configured for receiving a sensed property of the HVAC component; a wireless network interface configured for operation in an ad-hoc mode and an infrastructure mode; a processor; and non transitory memory including a set of executable instructions which, when executed by the processor, cause the fault detection and diagnostic module to operate the wireless network interface in an ad-hoc mode to communicate with a user device; receive network credentials from the user device; utilize the network credentials operate the wireless network interface in an infrastructure mode to communicate with a wireless router; and transmit an association request via the wireless network interface in an infrastructure mode to a remote diagnostic server.

Aspect 14. The fault detection and diagnostic module according to aspect 13, wherein the set of executable instructions, when executed by the processor, further cause the fault detection and diagnostic module to receive an association results message from the remote diagnostic server indicative of the results of an association process.

Aspect 15. The fault detection and diagnostic module according to any of aspects 13-14, wherein the set of executable instructions, when executed by the processor, further cause the fault detection and diagnostic module to transmit a message based at least in part upon the association results message to the user device.

Aspect 16. The fault detection and diagnostic module according to any of aspects 13-15, wherein the set of executable instructions, when executed by the processor, further cause the fault detection and diagnostic module to receive an association initialization request from the user device.

Aspect 17. The fault detection and diagnostic module according to any of aspects 13-16, wherein the set of executable instructions, when executed by the processor, further cause the fault detection and diagnostic module to transmit a diagnostic message to the remote diagnostic server in accordance with a sensed property of the HVAC component received by the electrical interface.

Aspect 18. The fault detection and diagnostic module according to any of aspects 13-17, further comprising a diagnostic data bus communications interface configured for receiving diagnostic data from a second fault detection and diagnostic module.

Aspect 19. The fault detection and diagnostic module according to any of aspects 13-18, wherein the set of executable instructions, when executed by the processor, further cause the fault detection and diagnostic module to transmit diagnostic data received from a second fault detection and diagnostic module to the remote diagnostic server.

Aspect 20. An HVAC diagnostic system, comprising an HVAC system comprising a thermostat having an Internet connection through a router; indoor HVAC equipment comprising a plurality of components electrically connected to the thermostat, outdoor HVAC equipment comprising a plurality of components electrically connected to the thermostat, and one or more diagnostic modules having a wireless Internet connection through a router, wherein the diagnostic modules receive sensor data from the indoor HVAC equipment and the outdoor HVAC equipment and send messages through the Internet; and a diagnostic server, comprising an Internet interface configured to send a command message to the thermostat directing operation of the plurality of components in the indoor HVAC equipment and the outdoor HVAC equipment, and receive a message comprising HVAC system identifying information and HVAC system process information from the one or more diagnostic modules; and a database configured to record an association of the thermostat with the diagnostic module.

Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. A method of a diagnostic server digitally associating a diagnostic module with a system controller in a heating, ventilation, and air conditioning (HVAC) system, the diagnostic module and the system controller connected to a local network at a customer site, a network address from which the system controller is accessible being associated with the system controller at the diagnostic server, the method comprising:

receiving an association request from the diagnostic module that includes the network address;

identifying the system controller from the network address as received from the diagnostic module;

sending a command message to the system controller at the network address to direct a defined operation of a component in the HVAC system;

receiving a status message from the diagnostic module that indicates the component is operating according to the defined operation; and determining that the diagnostic module and the system controller are associated based on the status message.

2. The method of claim 1, wherein the system controller comprises a thermostat.

3. The method of claim 1, wherein the network address is shared by the system controller and the diagnostic module, and the association request is received from the diagnostic module and includes at the network address of the diagnostic module and thereby the system controller.

4. The method of claim 3, wherein the network address is a public IP address assigned to the local network at the customer site, and the association request is received from the diagnostic module at the public IP address.

5. The method of claim 1, wherein the command message is sent to direct the defined operation that has an expected response from the component, the status message includes a response detected by the diagnostic module, and determining that the diagnostic module and the system controller are associated includes determining that the response detected by the diagnostic module matches the expected response.

6. The method of claim 1, wherein the HVAC system includes indoor HVAC equipment, outdoor HVAC equipment, or a combination of indoor HVAC equipment and outdoor HVAC equipment, and the command message is sent to the system controller to direct the defined operation of at least one of the indoor HVAC equipment or the outdoor HVAC equipment.

7. The method of claim 1, wherein the system controller comprises a thermostat, and the method further comprises at the diagnostic server:

receiving thermostat events from the thermostat;

receiving diagnostic events from a second diagnostic module that is not known to be associated with the thermostat;

determining a correlation between the thermostat events and the diagnostic events; and determining that the second diagnostic module and the thermostat are associated based on the correlation.

8. The method of claim 7, wherein the correlation indicates a degree of confidence that the second diagnostic module and the thermostat are associated, and the second diagnostic module and the thermostat are determined to be associated when the degree of confidence meets or exceeds a predetermined confidence threshold.

9. The method of claim 8, wherein the thermostat events and the diagnostic events are received over a period of time, and wherein the correlation including the degree of confidence is determined over the period of time until the degree of confidence meets or exceeds the predetermined confidence threshold.

10. A diagnostic server for a heating, ventilation, and air conditioning (HVAC) system, the diagnostic server configured to digitally associate a diagnostic module with a system controller in the HVAC system, the diagnostic module and the system controller connected to a local network at a customer site, a network address from which the system controller is accessible being associated with the system controller at the diagnostic server, the diagnostic server comprising:

a processor; and a memory storing executable instructions that, when executed by the processor, cause the diagnostic server to at least:

receive an association request from the diagnostic module that includes the network address;

identify the system controller from the network address as received from the diagnostic module;

send a command message to the system controller at the network address to direct a defined operation of a component in the HVAC system;

receive a status message from the diagnostic module that indicates the component is operating according to the defined operation; and determine that the diagnostic module and the system controller are associated based on the status message.

11. The diagnostic server of claim 10, wherein the network address is shared by the system controller and the diagnostic module, and the association request is received from the diagnostic module and includes at the network address of the diagnostic module and thereby the system controller.

12. The diagnostic server of claim 11, wherein the network address is a public IP address assigned to the local network at the customer site, and the association request is received from the diagnostic module at the public IP address.

13. The diagnostic server of claim 10, wherein the command message is sent to direct the defined operation that has an expected response from the component, the status message includes a response detected by the diagnostic module, and the diagnostic server caused to determine that the diagnostic module and the system controller are associated includes the diagnostic server caused to determine that the response detected by the diagnostic module matches the expected response.

14. The diagnostic server of claim 10, wherein the HVAC system includes indoor HVAC equipment, outdoor HVAC equipment, or a combination of indoor HVAC equipment and outdoor HVAC equipment, and the command message is sent to the system controller to direct the defined operation of at least one of the indoor HVAC equipment or the outdoor HVAC equipment.

15. The diagnostic server of claim 10, wherein the system controller comprises a thermostat, and the memory stores the executable instructions that, when executed by the processor, cause the diagnostic server to further at least:

receive thermostat events from the thermostat;

receive diagnostic events from a second diagnostic module that is not known to be associated with the thermostat;

determine a correlation between the thermostat events and the diagnostic events; and determine that the second diagnostic module and the thermostat are associated based on the correlation.

16. The diagnostic server of claim 15, wherein the correlation indicates a degree of confidence that the second diagnostic module and the thermostat are associated, and the diagnostic server is caused to determine that the second diagnostic module and the thermostat are associated when the degree of confidence meets or exceeds a predetermined confidence threshold.

17. The diagnostic server of claim 16, wherein the diagnostic server is caused to receive the thermostat events and the diagnostic events over a period of time, and wherein the diagnostic server is caused to determine the correlation including the degree of confidence over the period of time until the degree of confidence meets or exceeds the predetermined confidence threshold.

* * * * *